US010575106B1

(12) United States Patent
Bergmann et al.

(10) Patent No.: US 10,575,106 B1
(45) Date of Patent: Feb. 25, 2020

(54) MODULAR HEARING AID

(71) Applicant: Oticon A/S, Smørum (DK)

(72) Inventors: Martin Bergmann, Smørum (DK); Poul Henriksen, Veksø (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/134,428

(22) Filed: Sep. 18, 2018

(51) Int. Cl.
*H04R 25/00* (2006.01)

(52) U.S. Cl.
CPC ..... *H04R 25/505* (2013.01); *H04R 25/554* (2013.01); *H04R 25/602* (2013.01); *H04R 25/604* (2013.01); *H04R 2225/021* (2013.01); *H04R 2225/025* (2013.01); *H04R 2225/31* (2013.01); *H04R 2225/51* (2013.01); *H04R 2225/55* (2013.01)

(58) Field of Classification Search
CPC ..... H04R 25/505; H04R 25/604; H04R 2225/02; H04R 2225/025; H04R 2225/31; H04R 2225/51; H04R 2225/55
USPC ..... 381/315
See application file for complete search history.

(56) References Cited

U.S. PATENT DOCUMENTS

| | | | | |
|---|---|---|---|---|
| 9,749,753 | B2 * | 8/2017 | Petersen | H04R 25/30 |
| 9,807,522 | B2 * | 10/2017 | Pedersen | H04R 25/505 |
| 10,181,328 | B2 * | 1/2019 | Jensen | H04R 5/033 |
| 10,327,078 | B2 * | 6/2019 | Pedersen | H04R 25/405 |
| 2019/0268706 | A1 * | 8/2019 | Solum | H04R 25/554 |
| 2019/0268707 | A1 * | 8/2019 | Solum | A61B 5/01 |

* cited by examiner

*Primary Examiner* — Phylesha Dabney
(74) *Attorney, Agent, or Firm* — Birch, Stewart, Kolasch & Birch, LLP

(57) ABSTRACT

A hearing aid for comprises an ITE-module and a BTE-module. The ITE module is adapted for being located at or in an ear canal of a user and comprises functional elements for providing a normal function of the hearing aid. The BTE-module is adapted for being located at or behind an ear of the user and comprises a rechargeable battery for providing electric energy to the ITE-module. The hearing aid further comprises a connecting part for mechanically and electrically connecting the ITE-module and the BTE-module. The connecting part comprises at least two electric conductors connected to the rechargeable battery and to the ITE-module to allow provision of electric energy to the ITE-module. The BTE-module may comprise a wireless interface to another device.

21 Claims, 9 Drawing Sheets

LOOK-UP

| V2'D [V] | V1'D(V1') [V] |
|---|---|
| 4.1 | 1.3 |
| 4.0 | 1.3 |
| 3.9 | 1.3 |
| 3.8 | 1.3 |
| • | • |
| • | • |
| • | • |
| 3.4 | 1.2 |
| 3.3 | 1.15 |
| 3.2 | 1.10 |
| 3.1 | 1.05 |

Trigger battery warnings

MODULAR HEARING AID

The present disclosure relates to hearing aids, in particular to hearing aids comprising a number of separate connectable modules. Each of the connectable modules may be arranged to have a separate housing for fully or partially enclosing the components of the module in question.

The modules are e.g. arranged to be mechanically connectable, e.g. adapted to be (easily) attached to and detached from each other. The modules are e.g. arranged to be electrically connectable, e.g. to allow electrical communication between (at least some of) the individual modules.

SUMMARY

In a first aspect, the hearing aid may e.g. comprise a) an ITE module adapted for being located at or in an ear canal of a user, b) a battery module comprising an energizing element for providing electric energy to the ITE module, and c) a connecting part for mechanically and electrically connecting the ITE module and the battery module.

In a second aspect, the hearing aid may e.g. comprise A) a BTE module adapted for being located at or behind an external ear (pinna) of a user, and B) a battery module comprising an energizing element for providing electric energy to the BTE module (and possibly to further modules connected to the BTE-module).

A Hearing Aid:

In a first aspect of the present application there is provided, a hearing aid for compensating a user's hearing impairment. The hearing aid comprises at least two separate modules, including, an ITE-module and a BTE-module. The ITE module is adapted for being located at or in an ear canal of a user, and comprises functional elements for providing a normal function of the hearing aid, including

- an input unit comprising a microphone for picking up sound from the environment and providing an electric input signal, and/or antenna and transceiver circuitry for wirelessly receiving a direct electric audio signal,
- a signal processor for processing an electric input signal according to the user's needs and providing a processed signal,
- a memory accessible to the signal processor; and
- a loudspeaker for converting an electric signal representing sound to sound, and
- optionally other functional elements for providing the normal function of the hearing aid.

The BTE-module is adapted for being located at or behind an ear or the user and comprises a rechargeable battery for providing electric energy to the ITE-module. The hearing aid further comprises a connecting part for mechanically and electrically connecting the ITE-module and the BTE-module, wherein the connecting part comprises at least two electric conductors electrically connected to the rechargeable battery and to the ITE-module to allow provision of electric energy to the ITE-module.

Thereby an improved hearing aid with built in flexibility is provided. Among the advantages of a modular hearing aid according to the present disclosure are that the behind the ear (BTE-) module can be easily replaced depending on user need:

- A part containing legacy Bluetooth for full Hi-fi stereo can be used, when appropriate.
- A smaller, cosmetic part with less features for beginners can be used, when appropriate.
- A larger part for super power with more battery capacity can be used, when appropriate.

- A health-oriented part with more health sensor support can be used, when appropriate.

Further, battery replacement is easy, just replace the BTE-module with a spare (fully charged) BTE-module, if battery life deteriorates.

Further, the hearing aid may be configured to be fully software-based, and comprise a wirelessly upgradeable architecture.

The term 'a normal function of a hearing aid' is in the present context taken to mean, to compensate for a user's hearing impairment by applying a frequency and level dependent gain (or attenuation) to a sound signal picked up (or otherwise received) from the environment of the user and to provide the processed signal as stimuli perceivable by the user as sound (e.g. an acoustic signal).

The electric conductors of the connecting element may be configured to support power distribution to the ITE-modules as well as communication between the BTE-module and the ITE-module. The connecting element may e.g. comprise three or more, such as at least four, electric conductors. The communication between the ITE- and BTE-modules may e.g. comprise the transfer of audio data (e.g. from a microphone of the BTE-module to the processor of the ITE-module (e.g. for spatial filtering), or from a microphone or from the processor of the ITE-part to a controller of the BTE-module, e.g. for being transmitted to another device via antenna and transceiver circuitry for implementing a wireless interface of the BTE-module.

The BTE-module may be configured to provide that the rechargeable battery has a capacity larger than 100 mAh, when fully charged. The hearing aid may be configured to provide more than 48 hours of operation without recharging the rechargeable battery.

The increased power capacity may be (fully or partially) used to improve audio performance (allow components of the ITE-module to consume more power, e.g. to increase processing power, or to allow microphones to consume more power (e.g. to reduce microphone noise), or to provide legacy Bluetooth compatibility (e.g. provide direct connection to mobile telephones (e.g. Android based telephones) from the hearing aid).

The hearing aid may be configured to provide that the rechargeable battery is a Li-Ion battery. The rechargeable battery may be a Ni-MH (nickel metal hydride) battery. The rechargeable battery may be a Li-Ion-Polymer battery The hearing aid may be configured to provide that the rechargeable battery is wirelessly rechargeable. In an embodiment, the hearing aid is configured to provide that the rechargeable battery is rechargeable via charging contacts on the BTE-module, e.g. using the same connector that connects the connecting element to the ITE-module.

The hearing aid may comprise antenna and transceiver circuitry for implementing a wireless interface allowing an exchange of data with another device. In an embodiment, the BTE-module comprises circuitry for implementing a wireless interface according to legacy Bluetooth for full Hi-fi stereo.

The hearing aid may comprise a programming interface for programming the configurable signal processor. In an embodiment, the hearing aid is configured to program the configurable signal processor via conductors of the connecting part. In an embodiment, the hearing aid, e.g. the BTE-module, comprises a wireless programming interface. In an embodiment, the hearing aid is configured to allow remote fitting and/or remote assistance.

The memory may comprise solid state, non-volatile memory, e.g. flash memory. In an embodiment, the memory comprises processing algorithms and corresponding settings. In an embodiment, the hearing aid is configured to provide that audiologic features are fully software-based, e.g. constituting a wirelessly upgradeable architecture, e.g. via a smartphone. In an embodiment, the memory comprises user specific data.

The hearing aid may comprise a user interface. The hearing aid may be configured to be remotely controlled via a smartphone and/or a smartwatch or similar body worn electronic device.

The hearing aid may—in a specific mode of operation—be configured to function as a wireless headset.

The microphone(s) of the hearing aid, e.g. the ITE-microphone, may be configured to pick up the user's own voice, at least in a specific communication mode of operation. The BTE-module may comprise one or more microphones (BTE-microphones). The BTE-microphones, possibly in cooperation with the ITE-microphone(s), may be configured to pick up the user's own voice.

The hearing aid may—in a specific communication mode of operation—be configured to transmit the user's own voice to another device, e.g. a telephone or another hearing aid.

The hearing aid may comprise a voice control interface.

The hearing aid may comprise a number of bio-sensors for monitoring the state or health of the user. In an embodiment, at least one of the number of bio-sensors is located in the BTE-module. In an embodiment, at least one of the number of bio-sensors is located in the ITE-module. At least one of the number of bio-sensors may be or comprise an electrode or an electric potential sensor (EPS), e.g. for measuring EEG or EOG potentials from the user's body (e.g. brain or eyes, respectively).

In an embodiment, the BTE-module is configured to be a cosmetic part, e.g. with less features for first time users or special occasions. In an embodiment, the BTE-module is configured to be a larger part for 'super power' use with more battery capacity for persons having severe hearing losses.

The BTE-module may be configured to be disposable. In an embodiment, the BTE-module is configured to be hermetically closed. The BTE-module may comprise a water proof sealing.

The ITE module may be adapted to be located in a soft part of the ear canal, e.g. deep in the ear canal, or it may be adapted to be at least partially inserted into the bony part of the ear canal. The ITE-module may comprise a housing having a fixed, e.g. elongate, cylindrical form. The ITE-module may comprise a housing having a form customized to a particular user's ear (e.g. ear canal).

The housing of the BTE-part may be customized to a particular user's ear (e.g. according to a user's wishes, e.g. to make it cosmetically attractive).

The rechargeable battery of the BTE-module may have an elongate form to adapt to a user's external ear. The BTE-module may be adapted in form and/or size to be located at the ear of the user with a primary view to a user's wishes, e.g. its non-visibility or cosmetic effect.

The hearing aid may consist of or comprise a hearing instrument, a headset, an earphone, an ear protection device or a combination thereof.

In a second aspect of the present application there is provided a hearing aid for compensating a user's hearing impairment, the hearing aid comprising at least two separate modules, including a BTE module, and a battery module adapted for being connected to the BTE-module, the BTE module and the battery module when connected to said BTE-module being adapted for being located at or behind an external ear (pinna) of a user, the BTE-module comprising one or more hearing aid components, a first battery of a first type exhibiting a first nominal voltage, the first nominal voltage being equal to, or converted to, a nominal supply voltage of said one or more hearing aid components, and a first electric connector configured to electrically connect said BTE-module to said battery part;

the battery module comprising a second battery of a second type exhibiting a second nominal voltage, wherein said second nominal voltage is different from said first nominal voltage, and a second electric connector configured to electrically connect said battery part to said BTE-module;

wherein the hearing aid comprises a voltage converter for converting said second nominal voltage said first nominal voltage, and wherein the hearing aid is configured to bypass the first battery and take over the supply of voltage to said one or more hearing aid components, when the battery module is electrically connected to the BTE-module.

The battery module may e.g. be used to provide a backup solution when a battery of the first type is depleted.

In an embodiment, the one or more hearing aid components comprises one or more of an input transducer (e.g. a microphone or a wireless receiver, a processor, an output transducer (e.g. a loudspeaker or a wireless transmitter). The first and second connectors are configured to match each other (e.g. in male-female configuration, e.g. a plug and socket solution). In an embodiment, the hearing aid (e.g. the BTE-module) comprises an electric connector. The electric connector may be a dedicated connector for electrically connecting the battery module to the BTE-module. The electric connector may e.g. be a DAI (Direct Audio Input) connector (e.g. for attaching an FM shoe), or a programming connector (e.g. allowing a processor of the hearing aid to be programmed or re-programmed via a PC or other processing device). The battery module may preferably be adapted to be electrically connected to hearing aid components of a BTE-module via the electric connector. Thereby a retro-fit solution may be povided. The electric connector of the BTE-module may e.g. be configured to support from two to five electric individual conductors.

The battery module may comprise electronic circuitry, including said voltage converter. In an embodiment, the battery contains the electronic circuitry that is necessary to adapt the second voltage to the first voltage. This has the advantage that the BTE-module can form part of an existing hearing aid comprising an audio interface (e.g. a DAI), or an FM-interface, or a programming interface.

The first battery of the first type may be a conventional, non-rechargeable, battery. The second battery of the second type may be a rechargeable battery. In an embodiment, the first nominal voltage of the first battery of the first type is smaller than the second nominal voltage of the second battery of the second type.

The hearing aid may comprise a memory containing voltage data V1'D representing a reference discharging curve of said first battery and corresponding voltage data V2'D of said second battery, the hearing aid being configured to control said voltage converter so that it provides a voltage V1'(t) when the current voltage of the second battery is V2'(t), where t represents a current time. The memory may be located in the BTE-module or in the battery module. The battery module may comprise an analogue to digital converter for converting the second voltage of the second battery to a digital value V2'D. The hearing aid, e.g. the voltage converter, may further comprise a digital to analogue converter to convert a digital value V1'D from the memory to an analogue value for controlling the voltage converter.

The battery-module may e.g. be hermetically closed (to protect its contents from a humid environment, and to avoid unauthorized access to the battery or batteries). The battery-module may e.g. be configured to be disposable (when it has to be replaced, e.g. when it has been subject to a certain number of recharging cycles).

Features of a Hearing Aid According to the First and Second Aspects:

The battery (or 'electric battery') may comprise one or more battery cells (e.g. electrochemical cells, e.g. fuel cells), e.g. two or more cells, such as three or more cells. A battery may be non-rechargeable or re-chargeable.

In an embodiment, the hearing aid is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the signal processor is configured to enhance input signals and to provide a processed output signal.

In an embodiment, the input unit comprises a wireless receiver for receiving a wireless signal comprising sound and for providing an electric input signal representing said sound. In an embodiment, the hearing aid comprises a directional microphone system adapted to spatially filter sounds from the environment, and thereby enhance a target acoustic source among a multitude of acoustic sources in the local environment of the user wearing the hearing aid. In an embodiment, the directional system is adapted to detect (such as adaptively detect) from which direction a particular part of the microphone signal originates. This can be achieved in various different ways as e.g. described in the prior art.

In an embodiment, the hearing aid comprises an antenna and transceiver circuitry for wirelessly receiving a direct electric input signal from another device, e.g. a communication device or another hearing aid. In an embodiment, the hearing aid comprises a (possibly standardized) electric interface (e.g. in the form of a connector) for receiving a wired direct electric input signal from another device, e.g. a communication device or another hearing aid. In an embodiment, the direct electric input signal represents or comprises an audio signal and/or a control signal and/or an information signal. In an embodiment, the hearing aid comprises demodulation circuitry for demodulating the received direct electric input to provide the direct electric input signal representing an audio signal and/or a control signal e.g. for setting an operational parameter (e.g. volume) and/or a processing parameter of the hearing aid. In general, a wireless link established by a transmitter and antenna and transceiver circuitry of the hearing aid can be of any type. In an embodiment, the wireless link is used under power constraints, e.g. in that the hearing aid comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation).

In an embodiment, the communication between the hearing aid and the other device is in the base band (audio frequency range, e.g. between 0 and 20 kHz). Preferably, communication between the hearing aid and the other device is based on some sort of modulation at frequencies above 100 kHz. Preferably, frequencies used to establish a communication link between the hearing aid and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM—Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing aids comprise an analogue-to-digital (AD) converter to digitize an analogue input (e.g. from an input transducer, such as a microphone) with a predefined sampling rate, e.g. 20 kHz. In an embodiment, the hearing aids comprise a digital-to-analogue (DA) converter to convert a digital signal to an analogue output signal, e.g. for being presented to a user via an output transducer.

In an embodiment, the hearing aid, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing aid from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing aid is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing aid is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing aid comprises a number of detectors configured to provide status signals relating to a current physical environment of the hearing aid (e.g. the current acoustic environment), and/or to a current state of the user wearing the hearing aid, and/or to a current state or mode of operation of the hearing aid. Alternatively or additionally, one or more detectors may form part of an external device in communication (e.g. wirelessly) with the hearing aid. An external device may e.g. comprise another hearing aid, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing aid comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing aid comprises an own voice detector for estimating whether or not (or with what probability) a given input sound (e.g. a voice, e.g. speech) originates from the voice of the user of the system. In an embodiment, a microphone system of the hearing aid is adapted to be able to differentiate between a user's own voice and another person's voice and possibly from NON-voice sounds.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

The number of detectors may include one or more detectors related to the health of the suer, e.g. one or more bio sensors, e.g. an or EEG sensor configured to pick up signals from the user's brain or other low voltage signals from the user's body, e.g. an EOG sensor for picking up potentials from the user's eye balls, and e.g. used to estimate a current eye gaze of the user. Such sensors may e.g. be used to control functionality of the hearing aid or other devices (e.g. to implement or form part of a brain computer interface). The sensors/electrodes may e.g. be located on an add-on (BTE) module of the hearing aid and/or on a 'stationary' or primary (ITE) module of the hearing aid.

In an embodiment, the hearing aid comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing aid, or other properties of the current environment than acoustic);

b) the current acoustic situation (input level, feedback, etc.), and c) the current mode or state of the user (movement, temperature, cognitive load, etc.);

d) the current mode or state of the hearing aid (program selected, time elapsed since last user interaction, etc.) and/or of another device in communication with the hearing aid.

In an embodiment, the hearing aid further comprises other relevant functionality for the application in question, e.g. feedback detection/suppression, compression, noise reduction, etc.

Use:

In an aspect, use of a hearing aid as described above, in the 'detailed description of embodiments' and in the claims, is moreover provided.

A Hearing System:

In a further aspect, a hearing system comprising a hearing aid as described above, in the 'detailed description of embodiments', and in the claims, AND an auxiliary device is moreover provided.

In an embodiment, the hearing system is adapted to establish a communication link between the hearing aid and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, the auxiliary device is or comprises a remote control for controlling functionality and operation of the hearing aid(s). In an embodiment, the function of a remote control is implemented in a SmartPhone, the SmartPhone possibly running an APP allowing to control the functionality of the audio processing device via the SmartPhone (the hearing aid(s) comprising an appropriate wireless interface to the SmartPhone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing aid.

In an embodiment, the auxiliary device is or comprises another hearing aid. In an embodiment, the hearing system comprises two hearing aids adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing aid or a hearing system described above in the 'detailed description of embodiments', and in the claims. In an embodiment, the APP is configured to run on cellular phone, e.g. a smartphone, or on another portable device allowing communication with said hearing aid or said hearing system.

Definitions

In the present context, a 'hearing aid' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing aid' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing aid may comprise a single unit or several units communicating electronically with each other.

More generally, a hearing aid comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing aids, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing aid and/or for storing information (e.g. processed information, e.g. provided by the signal processing circuit), e.g. for use in connection with an interface to a user and/or an interface to a programming device. In some hearing aids, the output means may comprise an output transducer, such as e.g. a loudspeaker for providing an air-borne acoustic signal or a vibrator for providing a structure-borne or liquid-borne acoustic signal. In some hearing aids, the output means may comprise one or more output electrodes for providing electric signals.

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A 'hearing system' refers to a system comprising one or two hearing aids, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Auxiliary devices may be e.g. remote controls, audio gateway devices, mobile phones (e.g. SmartPhones), public-address systems, car audio systems or music players. Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
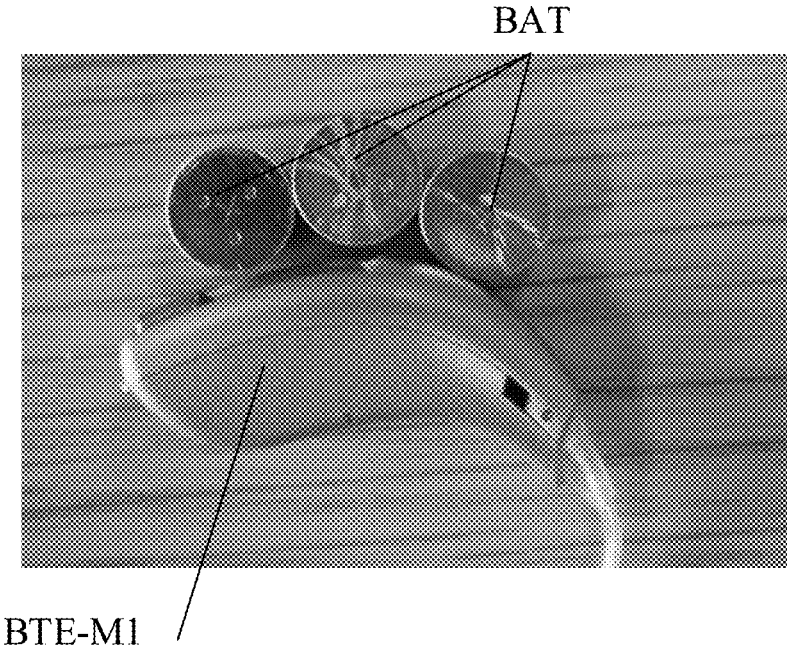
FIG. 1A illustrates that a relatively small RITE style hearing instrument has room for the equivalent of 3-4 A312-size batteries.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon the particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing aids, and describes in particular a modular rechargeable hearing instrument that significantly improves performance and adds important features compared to current offerings, while still having good cosmetics.

One of the biggest problems with modern hearing instruments (HI) is for users to change the small batteries. Changing batteries requires good vision and dexterity, which many HI users struggle with. The average age of first-time HI users is about 70 years. When changing battery, the user sometimes drops the battery and it gets lost.

Radically improving the basic HI product requires radical new thinking. The proposed solution enables:

- Superior battery life and longevity compared to current rechargeable solutions.
- Wireless software update.
- Improved audio bandwidth.
- Improved signal processing.
- Other features not previously possible because of the extreme power constraints of conventional His.

An exemplary modular hearing aid ($1^{st}$ aspect):

The proposed solution is modular so different trade-offs between cosmetics/features/battery life/audio quality can be made depending on user need.

Many other portable electronic devices have already transitioned to using rechargeable lithium ion batteries (exceptions include very low power remote controls and cheap toys). However, rechargeable batteries have not been practical in HIs because the small size of the His does not leave room for a battery large enough to achieve sufficient battery life and battery longevity.

By naively replacing currently used Zinc-Air batteries with Lithium-ion batteries of same size (e.g. A312), a battery life of approximately 20 hours is expected, requiring the user to charge the HI every night. If the user forgets to charge one night, he will have to wait for the HI to charge before use, which typically takes 2-3 hours. Another issue is that Lithium-ion battery performance start to deteriorate after approximately 300 deep charge cycles i.e. in less than one year of normal use, the user will experience decreasing battery performance.

It is proposed to make a new style combining an IIC/CIC style HI with a BTE body. The actual HI is the IIC/CIC while a rechargeable battery powering the HI occupies the whole or most of the cavity of the BTE-module.

This allows for a significantly larger battery compared to trying to cram a rechargeable battery in either a BTE or CIC style. Since the IIC/CIC part does not need a battery of its own, it can be made smaller than a full CIC/IIC. I.e. the solution is cosmetically attractive. Some widely used styles comprise a BTE-part and an ITE-part, the latter being either 1) a custom made mould adapted to the ear canal of the user (for relatively large hearing losses), or 2) a relatively open part comprising a loudspeaker (often termed 'receiver', for relatively small hearing losses). The latter style is sometimes nicknamed RITE (receiver in the ear).

Looking at an exemplary (state of the art) small RITE style HI (i.e. a hearing instrument comprising a receiver located in an ear canal and a (small) BTE-module located at or behind an ear of the user), a battery of 3-4 times the volume of the current A312 is possible, cf. FIG. 1A. The housing of the small RITE style HI was not designed to be a battery-pack so presumably the shape can be optimized to better fit the battery and the ear—since the BTE module according to the present disclosure mainly or only contains battery (or batteries), it does not need to sit on top of the ear (like a real BTE with directional microphones) and can be better concealed behind the ear.

Figure 1B:
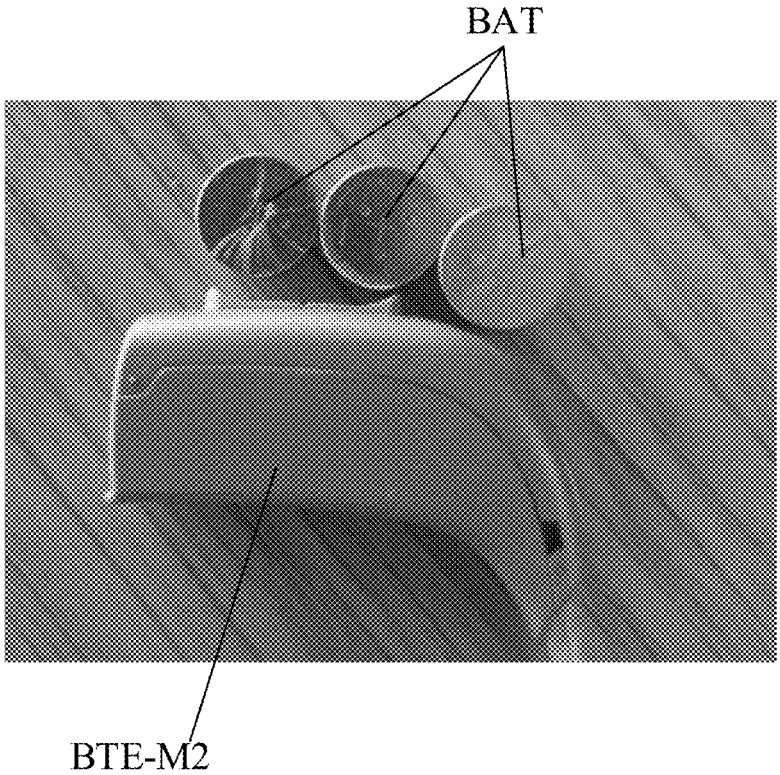
FIG. 1B illustrates a relatively larger RITE style hearing instrument, wherein the shell has room for an even bigger battery than the relatively small RITE shell.

FIG. 1A illustrates that a relatively small RITE style hearing instrument has room for the equivalent of 3-4 A312-size battery cells (BAT, and e.g. embodied in battery module BTE-M1), and FIG. 1B illustrates a relatively larger RITE style hearing instrument, wherein the shell has room for an even bigger battery (BAT) than the relatively small RITE shell (e.g. embodied in battery module BTE-M2, e.g. housing 3 larger size (e.g. larger capacity) battery cells or 4-6 A312 size cells).

Assuming that an A312 lithium ion battery lasts 20 hours—good for one day—this concept at least triples that to 60 hours using the size of the small RITE shell as battery module. Using the much larger RITE BTE style (cf. FIG. 1B) enables an even bigger battery.

After one year, a single A312 lithium ion battery HI will go through 365 deep cycles while this concept only uses approximately 100 cycles resulting in much better battery longevity. When battery performance eventually decreases, the battery module is easily replaceable since it attaches via a connector to the IIC/CIC part.

The extra battery power makes industry standard flash memory feasible, which has higher storage density and lower cost. Flash memory makes several valuable features feasible such as voice prompts and wireless SW update.

In addition to providing power to the HI, the battery module could also have a data wire to the HI making many other features possible.

An advantage of the modular hearing instrument is its flexibility and consequent many possible variations, exemplified in the following.

In an embodiment, the BTE-module contains a user interface, e.g. comprising one or more activation elements, e.g. one or more buttons.

In an embodiment, the BTE-module contains an additional microphone. This has the advantage of providing improved audiology and gain to the hearing aid.

In an embodiment, the BTE-module is configured to be smaller than a regular BTE HI for better cosmetics. Such module may exhibit a reduced battery life, e.g. 2 days.

In an embodiment, the extra battery power is used to provide higher audio quality (e.g. higher audio bandwidth closer to normal hearing and/or better signal processing).

In an embodiment, the BTE-module comprises a wireless interface configured to support wireless connectivity (e.g. based on Bluetooth, e.g. Bluetooth Low Energy (BLE), or equivalent technologies) to accessory devices, such as smartphones, microphones, audio delivery devices, tablets, PCs, household devices, sensors, etc.

In an embodiment, the BTE-module supports full legacy Bluetooth enabling compatibility with all Bluetooth-enabled mobile phones and accessories.

In an embodiment, the BTE-module comprises an antenna for supporting the wireless interface (e.g. at 2.4 GHz or more). In an embodiment, the connecting part comprises an antenna for supporting the wireless interface (e.g. at 2.4 GHz or more).

The BTE-module may contain a wireless interface for enabling wireless charging of the rechargeable battery. Alternatively of additionally, the BTE-module may contain an electric interface for enabling wired charging of the rechargeable battery (via charge contacts on the BTE-module). In other words wireless and/or wired charging may be enabled for the BTE-module. equivalent to the battery module of the hearing aid according to a second aspect or the present disclosure, see e.g. FIG. 9A, 9B, 9C and corresponding description.

In an embodiment, the extra power provided by the BTE-module is used to implement a super power rechargeable hearing aid in a small form factor. A rechargeable Li-ion battery allows for significantly higher power draw compared to zinc-air battery making more powerful HIs possible.

The modularity of a hearing aid according to the present disclosure allows a user to change the BTE-module to e.g.:

Smaller model for better cosmetics.

Larger model for better battery life.

A wireless capable model.

Figure 2:
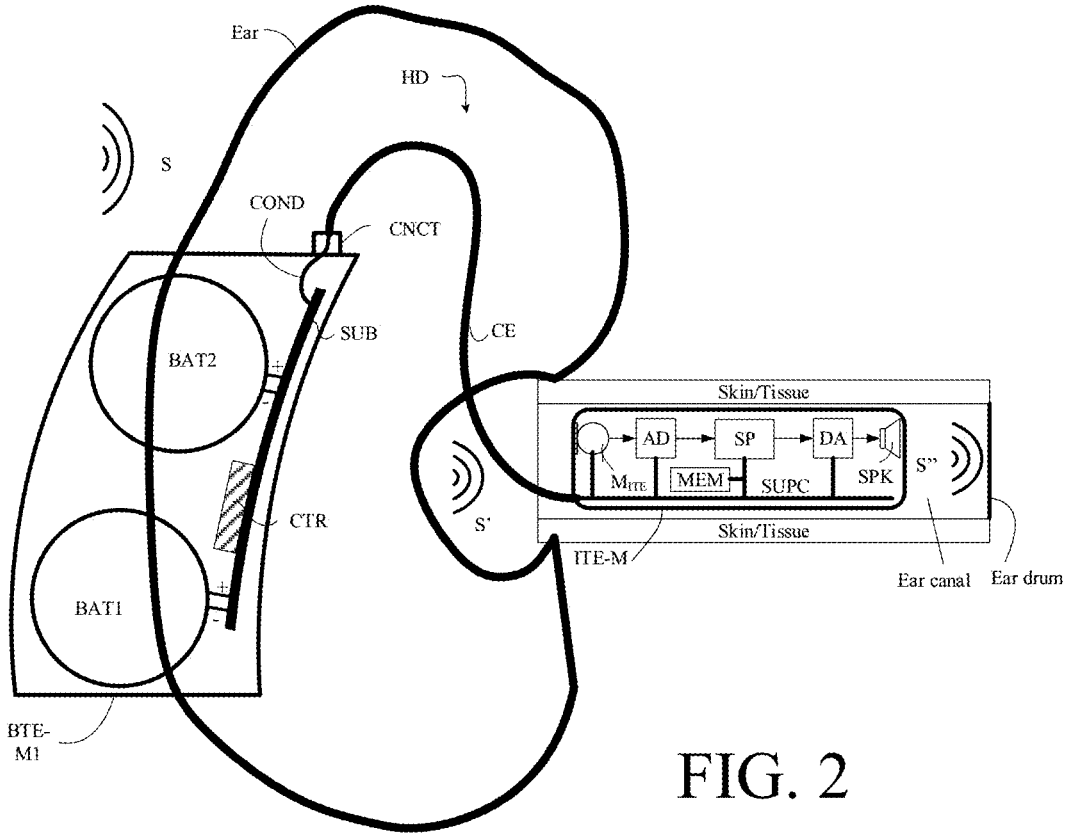
FIG. 2 shows a modular hearing aid according to a first embodiment of the present disclosure.

FIG. 2 shows a modular hearing aid according to a first embodiment of the present disclosure. The hearing aid (HD) is configured to compensate for a user's hearing impairment. The hearing aid comprises an ITE-module (ITE-M), a BTE-module (BTE-M1) and a connecting part (CE). The ITE-module is adapted for being located at or in an ear canal of a user and comprises functional elements for providing a normal function of the hearing aid. The ITE-module comprises a forward path from an input unit to an output transducer. The input unit comprises a microphone ($M_{ITE}$) for picking up sound (S') from the environment. The sound S' represents the sound field at the ear canal (enhanced by the external ear of the user) from the sound field S around the user. An analogue to digital converter (AD) samples the analogue input from the microphone and provides a digitized electric input signal. The ITE-module further comprises a configurable signal processor (SP) for processing the electric input signal according to the user's needs and providing a processed signal. The ITE-module further comprises a memory (MEM) accessible to the configurable signal processor (SP). Optionally, a digital to analogue converter (DA) converts the processed signal to an analogue output signal that is fed to the loudspeaker (SPK). The memory (MEM) may e.g. comprise flash memory. The memory may e.g. comprise different programs and configurations of the hearing aid which may be selected automatically or via a user interface. The loudspeaker converts the electric output signal representing sound to sound (S") for being delivered to the residual volume at the ear drum (Ear drum) of an ear canal (Ear canal) of the user. The ear canal is surrounded by skin and/or tissue (Skin/Tissue). The ITE module may be adapted to be located in a soft part of the ear canal, or it may be adapted to be at least partially inserted into the bony part of the ear canal. The ITE-module may optionally comprise other functional elements for providing a normal function of the hearing aid, e.g. feedback detection and/or suppression. The BTE-module (BTE-M) is adapted for being located at or behind an ear (Ear) or the user (or elsewhere on the head of the user, e.g. on a spectacle frame), and comprises a rechargeable battery (BAT1, BAT2) for providing electric energy to the ITE-module (and to any electronic components of the BTE-module itself). The BTE-module comprises a substrate SUB for carrying any electronic components and conductors of the BTE-module, cf. e.g. controller CTR for controlling the power distribution, and/or charging process (e.g. charging management circuitry) when the rechargeable batteries need to be recharged. The connecting part (CE) is configured to mechanically and electrically connect the ITE-module and the BTE-module. The connecting part comprises at least two electric conductors (COND) connected to the rechargeable battery (BAT1, BAT2) of the battery module (BAT-M1) and to the ITE-module (ITE-M) to allow provision of electric energy to the relevant functional elements of the ITE-module, cf. distribution network in the ITE-module denoted SUPC for distributing supply current to the electronic components of the ITE-module. The electric conductors (COND) of the connecting element (CE) may also represent signal conductors for transferring audio, or information or control signals between the BTE-module and the ITE-module (and/or internally in the ITE-module)) depending on the configuration of the hearing aid. One or more of the electric conductors (COND) of the connecting element (CE) may also form part of an antenna for implementing a wireless interface (e.g. Bluetooth) to another device. The connecting element (CE) and the BTE-module may e.g. comprise respective mating connectors (CNCT) for establishing electric contact between the BTE- and ITE-modules (via conductors COND), and allowing easy exchange of the BTE-module, e.g. when the battery has been recharged a certain number of times. Alternatively, or additionally, the ITE-part may comprise respective mating connectors for establishing electric contact between the BTE- and ITE-modules (via conductors COND). The BTE-module may e.g. comprise a user interface, e.g. in the form of one or more activation elements, e.g. buttons or other touch sensitive elements. The user interface may e.g. be used to indicate a specific program or configuration of the hearing aid (or to control volume or loudness of the hearing aid). The ITE-module may preferably comprise antenna and transceiver circuitry allowing a wireless communication interface to be established to another device, e.g. to a programming device (e.g. for wirelessly configuring the hearing aid, e.g. by up-loading software or algorithms from a programming device (e.g. a fitting system) to the hearing aid (e.g. to the memory (MEM)).

Figure 3:
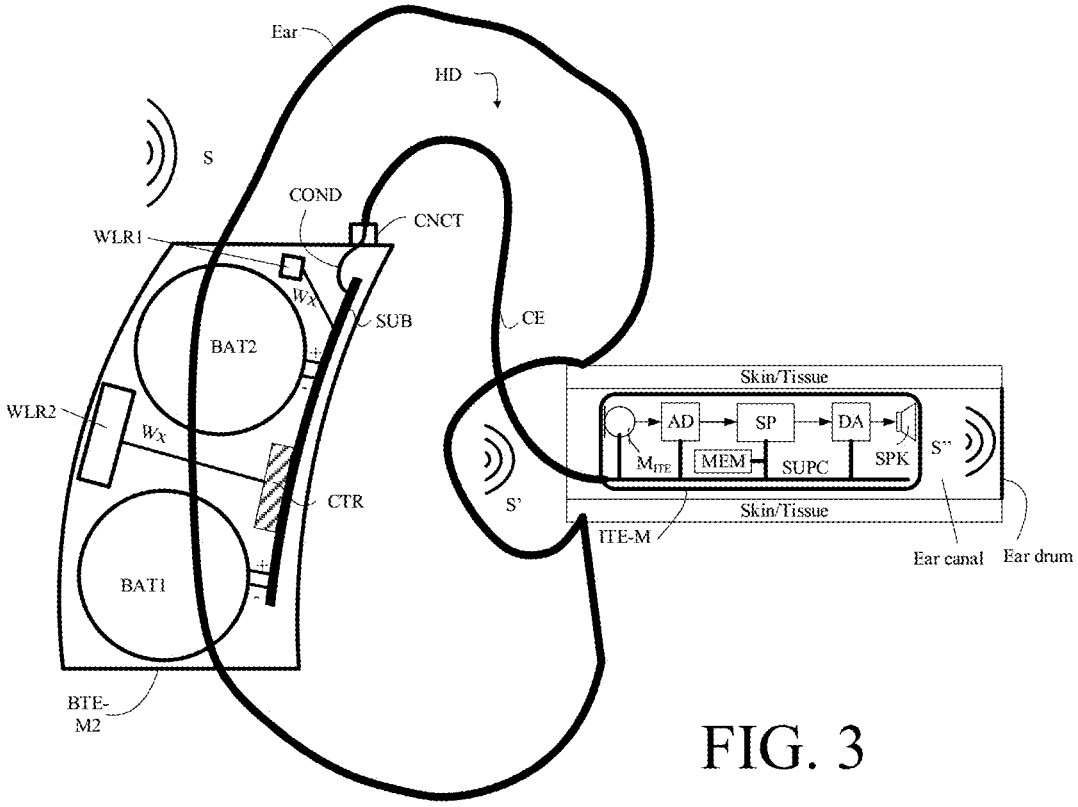
FIG. 3 shows a modular hearing aid according to a second embodiment of the present disclosure, FIG. 4A schematically shows a modular hearing aid according to the present disclosure wirelessly connected to a programming device via a direct connection, and FIG. 4B schematically shows a modular hearing aid according to the present disclosure wirelessly connected to programming device via a network (remote fitting)

FIG. 3 shows a modular hearing aid according to a second embodiment of the present disclosure. The embodiment of FIG. 3 is similar to the embodiment of FIG. 2. FIG. 3. however, shows an embodiment of a hearing aid (HD), wherein the BTE-module (BTE-M2) comprises antenna and transceiver circuitry (WLR1, WLR2) for implementing two wireless interfaces, allowing wirelessly exchanging (receiving from and/or transmitting to) electric audio signals with an auxiliary device (e.g. communication device, such as a smartphone, or a microphone, e.g. a partner microphone), and exchanging data with another device, e.g. another hearing aid, and/or a remote control device or a smartphone or a smartwatch or the like, or a programming device. The wireless interface may e.g. be configured to allow a user interface to be established, e.g. on a smartphone or other portable (e.g. handheld or body worn) device. Two wireless interfaces are shown in the embodiment of FIG. 3. Embodiments of a BTE-module comprising only one wireless interface, or more than two wireless interfaces may likewise be envisioned. The wireless interface may e.g. be configured to allow a wireless link to a programming device (e.g. a fitting system) to be established. Thereby a wireless programming of the ITE-module can be facilitated (via the BTE-module (BTE-M2) and the connecting element (CE).

The user interface of the BTE-module indicated in FIG. 2, 3 may instead of buttons comprise a capacitive touch control, e.g. implementing one or more of the following features:

Volume Up: Swipe Up.

Volume Down: Swipe Down.

Tap: Answer call/Hangup/Start/stop TV streaming.

Tap & Hold: Activate Siri/Google Now.

Alternatively or additionally, a user interface may be implanted in a separate remote control device (e.g. on a smartphone, or a SmartWatch, or the like).

Figure 5A:
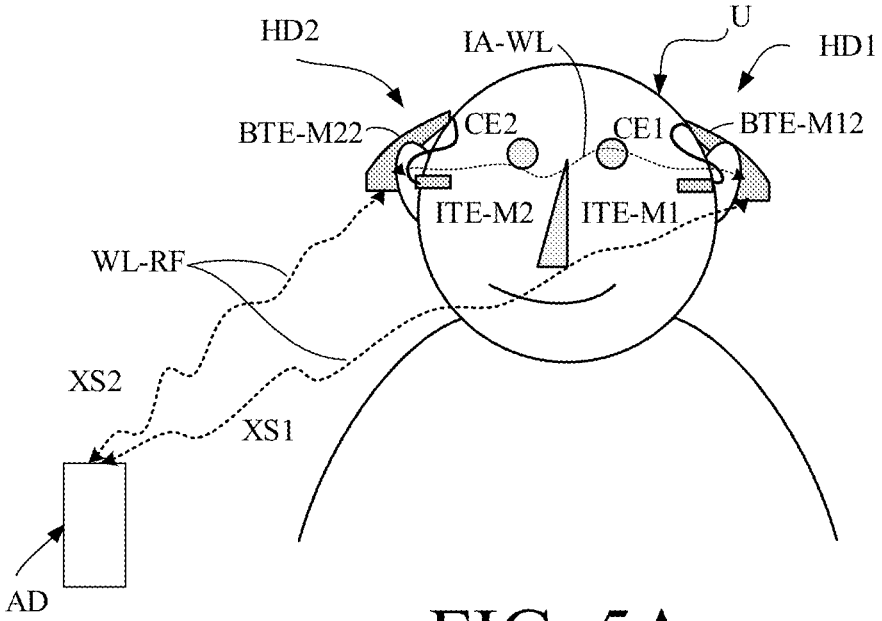
FIG. 5A shows a configuration of a hearing aid system according to the present disclosure comprising first and second hearing aids of a binaural hearing aid system and an auxiliary device implementing a user interface the hearing aid system.
Figure 5B:
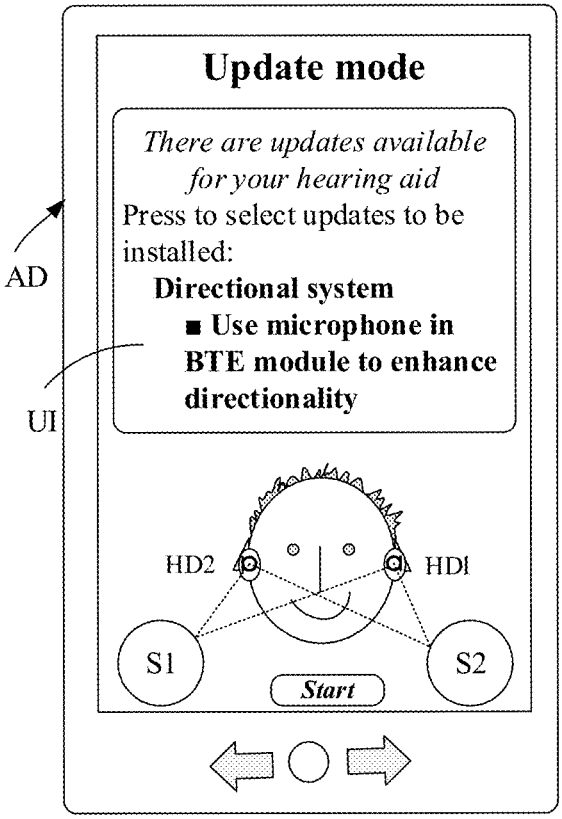
FIG. 5B illustrates a screen of an APP running on the auxiliary device and implementing the user interface.
Figure 5C:
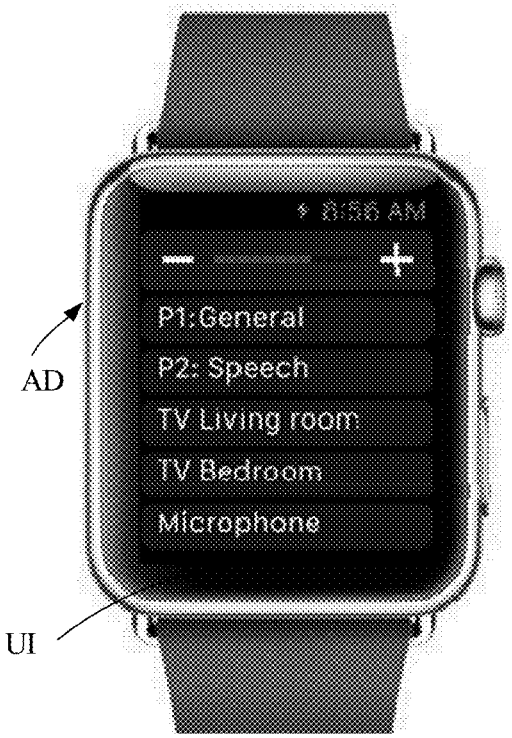
FIG. 5C illustrates a screen for an App or a smartwatch for remotely controlling a hearing aid or a hearing aid system according to the present disclosure, FIG. 6 schematically shows a first embodiment of a RITE style modular hearing aid according to the present disclosure, FIG. 7A schematically illustrates the conversion of a second voltage V2' of a rechargeable battery to a hearing aid supply voltage electronic components of a hearing aid, and FIG. 7B schematically illustrates (in the top graph) a discharging curve (battery voltage vs. time) for the rechargeable battery of FIG. 7A, incl. hypothetical voltages for issuing battery warnings to a user of the hearing aid, and (in the bottom graph) a regulated voltage (dashed curve) generated from the voltage V2 of the rechargeable battery, together with a typical discharging curve for a normal (non-rechargeable) battery, incl. typical voltages for issuing battery warnings to a user of the hearing aid.
Figure 9B:
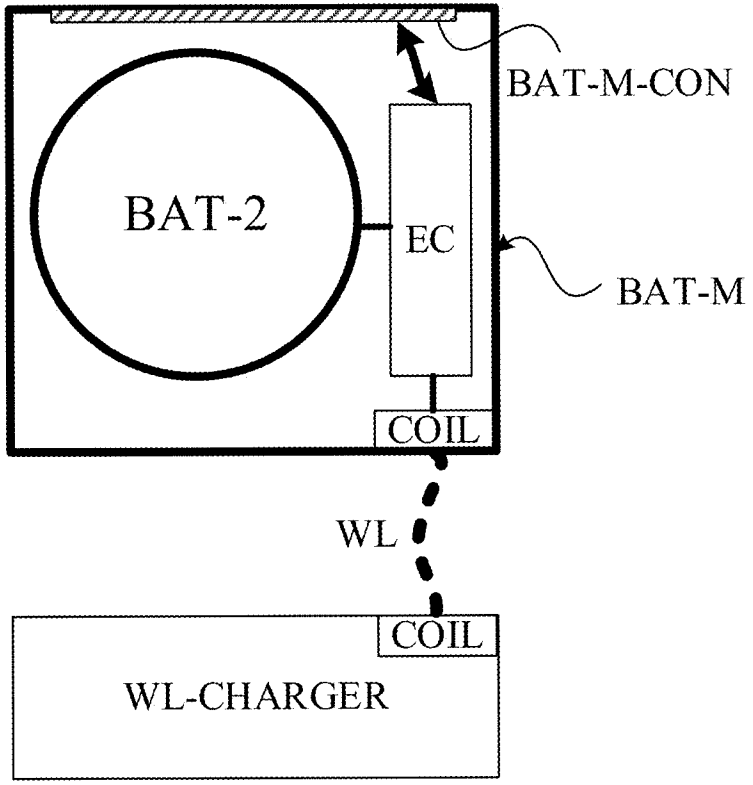
FIG. 9B schematically illustrates an embodiment of battery module as in FIG. 9A, but comprising a rechargeable battery for wireless recharging.
Figure 9A:
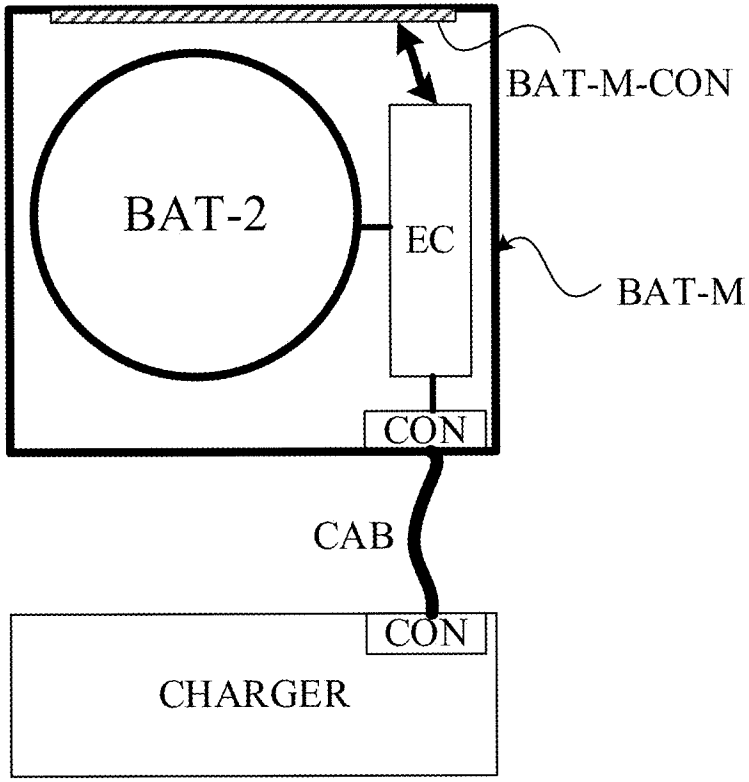
FIG. 9C illustrates a charger cradle suitable for left and right modular hearing aids for wireless or wired recharging of a battery module comprising rechargeable battery.
Figure 9C:
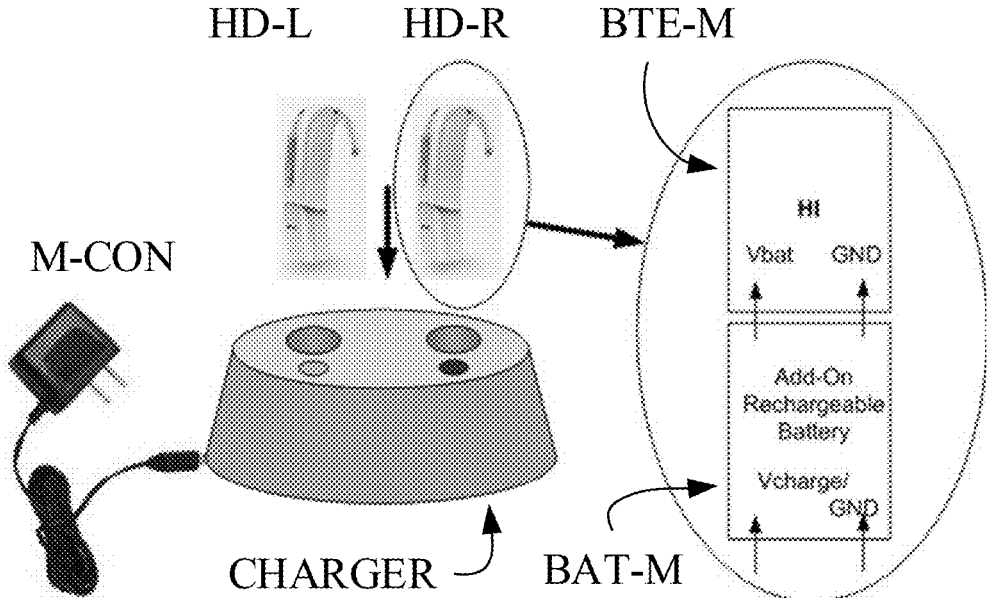

The BTE-module comprising a battery and optionally one or more wireless interfaces and optionally a microphone facilitates the implementation of a number of features (even though the main part of the hearing aid, the ITE-part does not have capacity for such features), e.g.:

- Instant self-fitting or update of hearing aid(s) via APP, cf. e.g. FIG. 5B.
- Remote assistance
- Remote user interface (e.g. in smartphone or smartwatch or the like), cf. e.g. FIG. 5C.
- Wireless rechargeable >48 h battery life, cf. e.g. FIG. 9A, 9B, 9C.
- Wireless 2-way headset using HI microphones. A user's own voice may be picked up by the microphone of the ITE-module or by a microphone of the BTE-module (or by a beamformer comprising a combination of the microphones).
- Automatic partner microphone (either a separate microphone or a microphone of another (partner) hearing aid). The hearing aid may be configured to receive an audio signal from a microphone worn by a communication partner and transmitted by the hearing aid (by reception in the BTE-module), e.g. automatically, when proximity between hearing aid and partner microphone is detected, or enabled by the user via a user interface. If the partner microphone is a microphone of another hearing aid (e.g. a hearing aid of a known communication partner, e.g. a spouse), the hearing system may (in partner microphone mode) be configured to pick up the user's own voice and transmit it to the other hearing aid (or hearing aid system).
- Modular design for easy differentiation and serviceability.
- Extensive use of Smartphone capabilities (cf. FIG. 5B).
- Data is 'raw material' for constant improvements. The Smartphone may log corresponding representations of user behavior and acoustic environments (possibly storing such data on a server). Such data may (with user acceptance) be used to propose changes to the user's settings and/or propose new features that can be uploaded to the user's hearing aid(s) via the remote control/smartphone, cf. e.g. FIG. 5B. Alternatively or additionally, such data may be used as inspiration to new features for future products.
- Fitting data may include a user profile.

Hearing aid and connectivity usage logging may be performed.

Hearing aid data logging may be performed.

Usage logging may be performed.

APP/Smartphone data logging may be performed.

Surveys may be pushed to user via APP.

Sound environments of the user may be recorded.

Data may be used for constant improvements of products and services, such as:

Better optimized and customized haring aid settings.

Better advice to dispensers and users.

Constant training of decision engine accelerating product improvements.

In case, the BTE-module does not contain any microphone or loudspeaker units (and no Zn-Air battery), the BTE-module may e.g. be hermetically closed. Thereby a risk of 'unauthorized' access to the rechargeable batteries may also be reduced. The BTE-part and the ITE-part may be covered with appropriate water repellent coating.

Figure 4A:
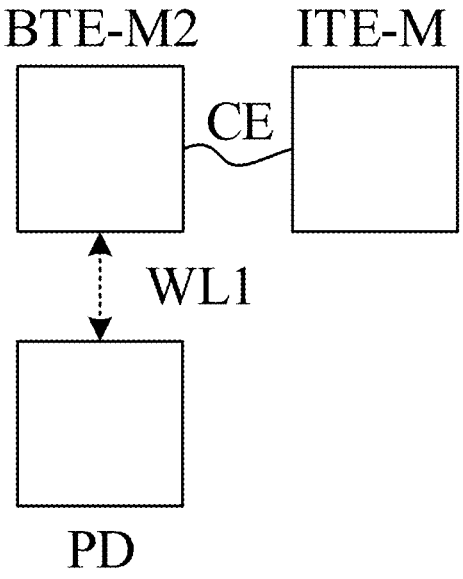

FIG. 4A schematically shows a modular hearing aid according to the present disclosure wirelessly connected to a programming device via a direct connection. Thereby wireless fitting of the ITE-module can be conveniently provided via the BTE-module (BTE-M2 in FIG. 3). If the programming device is a remote control or a smartphone, user-initiated or controlled fitting of the hearing aid can be facilitated.

Figure 4B:
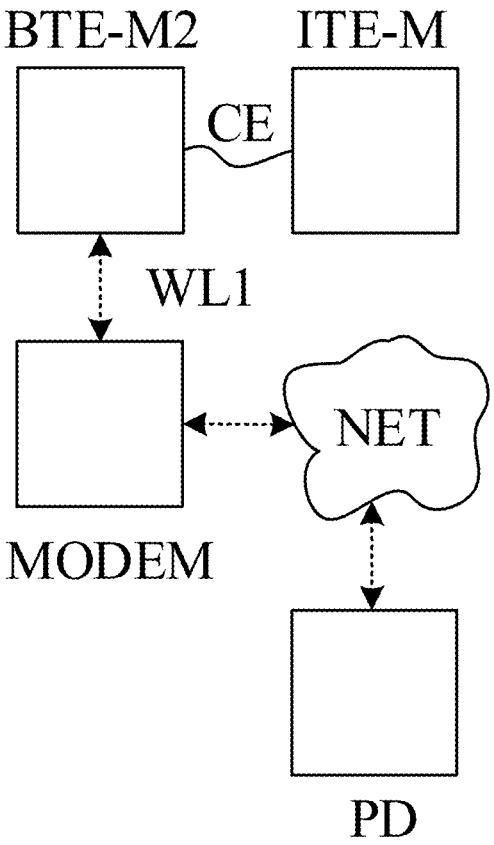

FIG. 4B schematically shows a modular hearing aid according to the present disclosure wirelessly connected to a programming device via a network (remote fitting). Thereby remote fitting and update of the hearing aid (in particular, the ITE-module) can be conveniently provided via the BTE-module (BTE-M2 in FIG. 3).

FIG. 5A, 5B 5C show exemplary application scenarios of embodiments of a hearing system according to the present disclosure.

FIG. 5A shows a configuration of a hearing system according to the present disclosure comprising first and second hearing aids (HD1, HD2) of a binaural hearing aid system worn by a user (U) and an auxiliary device (AD) comprising a user interface (UI) for the hearing system. FIG. 5B illustrates the auxiliary device, e.g. a dedicated remote control device or a smartphone (AD) running an APP for performing a software update procedure of the hearing aid system. FIG. 5C illustrates a screen for an APP of a smartwatch (AD) for implementing a user interface for remotely controlling a hearing aid or a hearing aid system according to the present disclosure. Each of the respective APPs of the remote control device/smartphone/smartwatch are implemented as a non-transitory application (APP) comprising executable instructions configured to be executed on the auxiliary device to implement a user interface (UI) for the hearing aid(s) (HD1, HD2) or the hearing system. The first and second hearing aids (HD1, HD2) are first and second modular hearing aids according to the present disclosure, each comprising respective BTE- and ITE-modules and connecting elements (BTE-M12, BTEM-22), (ITE-M1, ITE-M2) and (CE1, CE2), respectively. The auxiliary device (AD) comprising the user interface (UI) is preferably adapted for being held in a hand of a user (U) (cf. e.g. smartphone of FIG. 5B) or adapted to be worn by a user (cf. e.g. smartwatch of FIG. 5C).

In the embodiment of FIG. 5A, wireless link denoted IA-WL (e.g. an inductive link) between the first and second hearing aids (HD1, HD2), and wireless links denoted WL-RF (e.g. RF-links (e.g. Bluetooth, e.g. BLE)) between the auxiliary device (AD) and the left (HD1) hearing aid and between the auxiliary device (AD) and the right (HD2) hearing aid, respectively, are indicated. The wireless links are implemented in the devices by corresponding antenna and transceiver circuitry.

FIG. 5B illustrates a user interface (UI) implemented as an APP according to the present disclosure running on the auxiliary device (AD). The user interface comprises a display (e.g. a touch sensitive display). Via the display of the user interface, the user can interact with the hearing aid system and hence control functionality of the system. The illustrated screen of the 'Update mode'-APP allows the user to activate an update mode for updating software (e.g. firmware) of the hearing aid or hearing aids and/or for configuring algorithms and/or settings of the hearing aid(s). The screen contains instructions to the user to initiate the update, cf. instruction 'Press to select updates to be installed' and following Start button. The screen further contains a list of updates, in this example an update of the Directional system regarding the use of a microphone in the BTE-module (together with the microphone of the ITE-module, cf. e.g. FIG. 3) to enhance directionality.

The auxiliary device (AD) of FIG. 5B may be constituted by a smartphone or similar device.

The interaction with a smartphone (or other device with communication and processing capability) has several advantages:

In a modular hearing aid (or hearing system) according to the present disclosure, a smartphone may be used as compute engine running vastly more advanced algorithms than possible on a hearing aid, e.g. utilizing machine learning techniques, such as deep learning (or deep neural networks).

The use of a smartphone leverages cloud services and big data for improving user experience, getting data from millions of users. Data gathered from sensors and user feedback may be fed into a 'Watson'-like decision optimization engine (cf. IBM).

The use of smartphones may conveniently feed regular settings updates to the hearing aid so it's always up-to-date (cf. FIG. 5B).

The use of smartphones may facilitate easy alert or relevant parties (e.g. a user, a hearing care professional (HCP), a hearing aid manufacturer, etc.) if a problem is detected.

Health monitoring may be enhanced by a combination of sensors located in the smartphone and in the hearing aid(s).

Extensive user customization depending on scenario automatically and/or via a user interface is possible using the capabilities of the smartphone (touch screen, processing power, sensors, network access, etc.).

The auxiliary device (AD) may be constituted by or comprise a remote control for controlling functionality and operation of the hearing aid(s). In the embodiment of FIG. 5C, the function of a remote control is implemented in a smartwatch, the smartwatch possibly running an APP allowing to control functionality of the hearing aid(s) via a touch sensitive display of the smartwatch. In the screen of FIG. 5C, the user can select various hearing aid programs (cf. P1: General, or P2: Speech) and select direct sound inputs from a number of sources, e.g. sound from different TV sets and microphones (the latter e.g. worn by a communication partner) (cf. TV Living room, TV Bedroom, Microphone).

The user interface of the BTE-module/smartphone/smartwatch implementations indicated in FIG. 5B, 5C may comprise one or more of the following features:

Capacitive touch control (BTE-module).

Volume Up: Swipe Up (smartphone/smartwatch).

Volume Down: Swipe Down (smartphone/smartwatch).

Tap: Answer call/Hangup/Start/stop TV streaming

Tap & Hold: Activate Siri/Google Now

Remote control on Smartphone and SmartWatch

An exemplary modular hearing aid ($2^{nd}$ aspect):

When a battery in a hearing instrument (HI) depletes, the voltage decreases gradually over time and to ensure a good user experience and to advise the HI user that the battery is about to deplete, the HI may advise the user by e.g. audio warning sounds. The trigger for this battery low state is the voltage level of the battery and this triggering threshold can be defined from a desired remaining usage time to allow the user to prepare for battery exchange.

When a rechargeable battery is used, this battery can operate at a voltage different from the normal battery voltage and a voltage conversion is needed. Voltage converters are often regulated, and their output voltage will normally not decrease with depleting battery voltage until shutdown and the HI will shut down abruptly without any warnings.

If the regulated voltage imitates the decreasing voltage of a depleting normal battery (e.g. a non-rechargeable battery, e.g. a Zn-Air battery) corresponding to the battery depletion state of the rechargeable battery, all warnings will work as usual and will result in the same user experience irrespective if a normal or a rechargeable battery is used. This may be of particular interest in hearing instruments, configured to allow different kinds of batteries to be used, e.g. non-rechargeable batteries (e.g. Zn-Air) and rechargeable batteries (e.g. Ni-MH (nickel metal hydride) or Li-Ion).

In an embodiment, the hearing aid is configured to use a first battery of a first type exhibiting a first nominal voltage (of a single battery cell when fully charged). In an embodiment, the hearing aid is configured additionally use a second battery of a second type exhibiting a second nominal supply voltage (of a single battery cell when fully charged) different from said first nominal supply voltage. In an embodiment, the first battery form part of a BTE-module comprising one or more hearing aid components (e.g. one or more of an input transducer (e.g. a microphone or a wireless receiver, a processor, an output transducer (e.g. a loudspeaker or a wireless transmitter). In an embodiment, the second battery form part of a battery module (e.g. together with electronic circuitry). The hearing aid may be configured to bypass the first battery when the second battery is connected to the hearing aid, e.g. when the battery module is connected to the BTE-module.

In an embodiment, the hearing aid (e.g. the BTE-module) comprises an electric connector. The electric connector may be a dedicated connector for electrically connecting the battery module to the BTE-module. The electric connector may e.g. be a DAI (Direct Audio Input) connector (e.g. for attaching an FM shoe), or a programming connector (e.g. allowing a processor of the hearing aid to be programmed or re-programmed via a PC or other processing device). The battery module may preferably be adapted to be electrically connected to hearing aid components of a BTE-module via the electric connector. Thereby a retro-fit solution may be provided. The electric connector of the BTE-module may e.g. be configured to support from two to five electric individual conductors.

The battery module may e.g. be used to provide a backup solution when a battery of the first type is depleted.

In an embodiment, the first battery of the first type is a conventional (non-rechargeable) battery. In an embodiment, the second battery of the second type is a rechargeable battery. In an embodiment, the first nominal supply voltage of the first battery of the first type is smaller than the second nominal supply voltage of the second battery of the second type.

Figure 6:
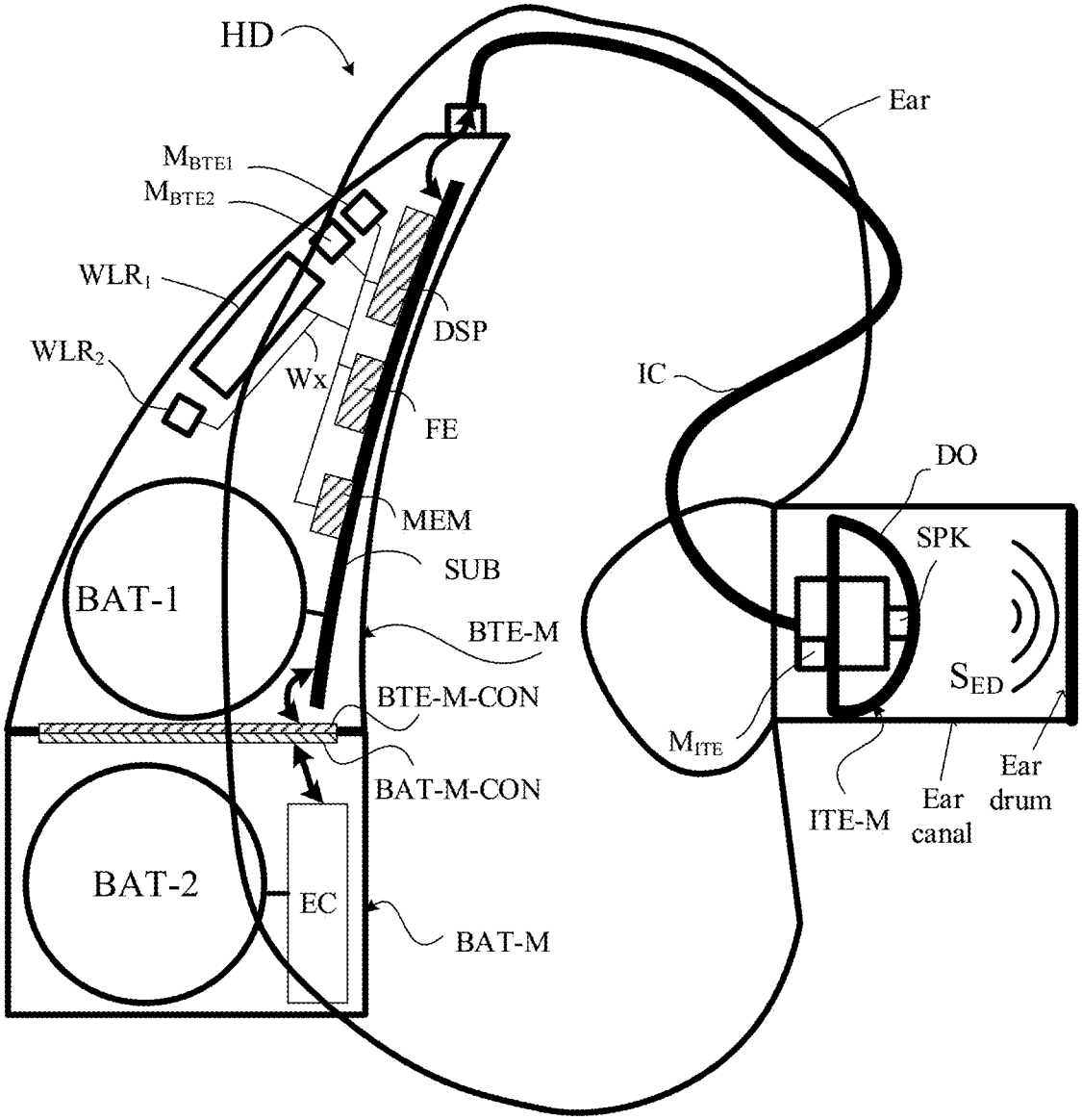

FIG. 6 shows a first embodiment of a RITE style modular hearing aid (HD) according to the present disclosure. The hearing aid (HD) is e.g. adapted for compensating a user's hearing impairment. The hearing aid comprises (at least two, here three) separate modules. The hearing aid (HD) comprises a BTE module (BAT-M), and a battery module (BAT-M), and an ITE-module (ITE-M), together constituting a RITE-style hearing aid. The battery module (BAT-M) is adapted for being connected to the BTE-module. The BTE module (BTE-M) and the battery module (BAT-M) are adapted for being located at or behind an external ear (pinna) of a user, when the battery module is connected to the BTE-module. The BTE-module comprises one or more hearing aid components and a first battery (BAT-1) of a first type (e.g. a non-rechargeable battery, e.g. a Zn-Air-battery) exhibiting a first nominal voltage (e.g. in the range from 1.3 V to 1.7 V, e.g. 1.4 V). The first nominal voltage is equal to, or converted to, a nominal supply voltage (e.g. 1.3 V) of the one or more hearing aid components. The BTE-module further comprises a first electric connector (BTE-M-CON) configured to electrically connect the BTE-module to the battery part. The battery module (BAT-M) comprises a second battery (BAT-2) of a second type (e.g. a rechargeable battery, e.g. a Li-Ion or a Ni-MH battery) exhibiting a second nominal voltage (e.g. in the range from 3.7 V to 4.2 V, e.g. 4.1 V). The second nominal voltage is different from said first nominal voltage, e.g. (substantially) larger. The battery module (BAT-M) further comprises a second electric connector (BAT-M-CON) configured to electrically connect the battery part to the BTE-module (together with the first electric connector (BTE-M-CON) of the BTE-module. The BTE-module further comprises electric circuitry (EC) connected to the second battery (BAT-2) and to the connector (see FIG. 6). The electric circuitry comprises a voltage converter (e.g. 'Voltage regulator' in FIG. 7A) for converting the second nominal voltage V2 (or the loaded voltage V2' in FIG. 7A) to the first nominal voltage V1 (or the loaded voltage V1' in FIG. 7B). The hearing aid (HD) is configured to bypass the first battery (BAT-1) and take over the supply of voltage to the one or more hearing aid components, when the battery module (BAT-M) is electrically connected to the BTE-module (BTE-M). This may e.g. be arranged by electric circuitry (EC) in the battery module (BAT-M) when the second connector (BAT-M-CON) and the first connector (BTE-M-CON) are electrically connected, possibly in cooperation with electric circuitry in the BTE-module connected to the first connector (BTE-M-CON), the first battery (BAT-1) and the hearing aid components of the BTE-module. The electric circuitry (EC) of the battery module (BAT-M) may further comprise a memory comprising a look-up table for use by a voltage regulator for translating the second battery voltage (V2) of BAT-2 to a first battery voltage (V1) of BAT-1 of the BTE-module.

In the embodiment of FIG. 6, the hearing aid is of a particular style (sometimes termed receiver-in-the ear, or RITE, style) comprising (in a normal operation without the 'backup' battery module) a BTE-module (BTE-M) adapted for being located at or behind an ear of a user, and an ITE-module (ITE-M) adapted for being located in or at an ear canal of the user's ear and comprising a receiver (loudspeaker). The BTE-module and the ITE-module are connected (e.g. electrically connected) by a connecting element (IC) and internal wiring in the ITE- and BTE-modules (cf. e.g. wiring Wx in the BTE-module). The connecting element may alternatively be fully or partially constituted by a wireless link between the BTE- and ITE-modules.

In the embodiment of a hearing aid in FIG. 6, the BTE module (BTE-M) comprises an input unit comprising respective input transducers (e.g. microphones) ($M_{BTE1}$, $M_{BTE2}$), each for providing an electric input audio signal representative of an input sound signal in the environment (e.g. originating from a sound field around the hearing aid). The input unit further comprises two wireless receivers ($WLR_1$, $WLR_2$) (or transceivers) for providing respective directly received auxiliary audio and/or control input signals (and/or allowing transmission of audio and/or control signals to other devices, e.g. a remote control or processing device). The hearing aid (HD) further comprises a substrate (SUB) whereon a number of electronic hearing aid components are mounted, including a memory (MEM) e.g. storing different hearing aid programs (e.g. parameter settings defining such programs, or parameters of algorithms, a look-up table for use by a voltage regulator for translating a second battery voltage (V2) to a first battery voltage (V1)) and/or hearing aid configurations, e.g. input source combinations ($M_{BTE1}$, $M_{BTE2}$, $WLR_1$, $WLR_2$), e.g. optimized for a number of different listening situations.

The substrate further comprises a configurable signal processor (DSP), e.g. a digital signal processor, e.g. including a processor for applying a frequency and level dependent gain, e.g. providing beamforming, noise reduction, filter bank functionality, and other digital functionality of a hearing aid according to the present disclosure. The configurable signal processor (DSP) is adapted to access the memory (MEM) and for selecting and processing one or more of the electric input audio signals and/or one or more of the directly received auxiliary audio input signals, based on a currently selected (activated) hearing aid program/parameter setting (e.g. either automatically selected, e.g. based on one or more sensors, or selected based on inputs from a user interface). The mentioned functional units (as well as other components) may be partitioned in circuits and components according to the application in question (e.g. with a view to size, power consumption, analogue vs. digital processing, etc.), e.g. integrated in one or more integrated circuits, or as a combination of one or more integrated circuits and one or more separate electronic components (e.g. inductor, capacitor, etc.). The configurable signal processor (DSP) provides a processed audio signal, which is intended to be presented to a user. The substrate further comprises a front-end IC (FE) for interfacing the configurable signal processor (DSP) to the input and output transducers, etc., and typically comprising interfaces between analogue and digital signals. The input and output transducers may be individual separate components, or integrated (e.g. MEMS-based) with other electronic circuitry.

The hearing aid (HD) further comprises an output unit (e.g. an output transducer) providing stimuli perceivable by the user as sound based on a processed audio signal from the processor or a signal derived therefrom. In the embodiment of a hearing aid in FIG. 6, the ITE module comprises the output unit in the form of a loudspeaker (also termed a 'receiver') (SPK) for converting an electric signal to an acoustic (air borne) signal, which (when the hearing aid is mounted at an ear of the user) is directed towards the ear drum (Ear drum), where sound signal ($S_{ED}$) is provided. The ITE-module further comprises a guiding element, e.g. a dome, (DO) for guiding and positioning the ITE-module in the ear canal (Ear canal) of the user. The ITE-module further comprises a further input transducer, e.g. a microphone ($M_{ITE}$), for providing an electric input audio signal representative of an input sound signal at the ear canal.

The electric input signals (from input transducers $M_{BTE1}$, $M_{BTE2}$, $M_{ITE}$) may be processed (e.g. to a spatially filtered, e.g. beamformed signal) in the time domain or in the (time-) frequency domain (or partly in the time domain and partly in the frequency domain as considered advantageous for the application in question).

The hearing aid (HD) exemplified in FIG. 6 is a portable device and further comprises a first battery (BAT-1) for energizing electronic components of the BTE- and possibly ITE-modules. In an embodiment, the hearing aid is adapted to provide a frequency dependent gain and/or a level dependent compression and/or a transposition (with or without frequency compression) of one or more frequency ranges to one or more other frequency ranges, e.g. to compensate for a hearing impairment of a user.

Figure 7A:
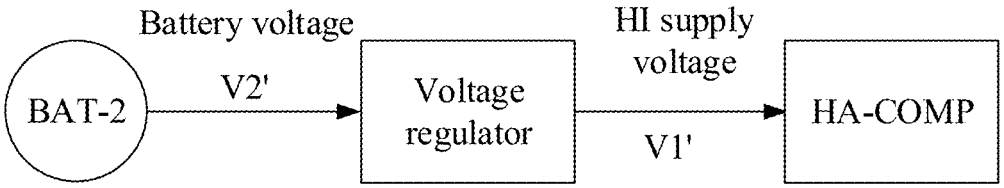

FIG. 7 shows the conversion of a second voltage V2' of a rechargeable battery to a hearing aid supply voltage for energizing electronic components of a hearing aid. The second rechargeable battery (BAT-2) provides voltage V2' to a voltage converter (cf. 'Voltage regulator' in FIG. 7A) providing a voltage V1' intended to be equal to a battery voltage of a first battery (cf. BAT-1 of the BTE-module (BTE-M) in FIG. 6) for use as voltage supply (cf. 'HI supply voltage' in FIG. 7A) to electronic components of the hearing aid (cf. block HA-COMP in FIG. 7A).

Figure 7B:
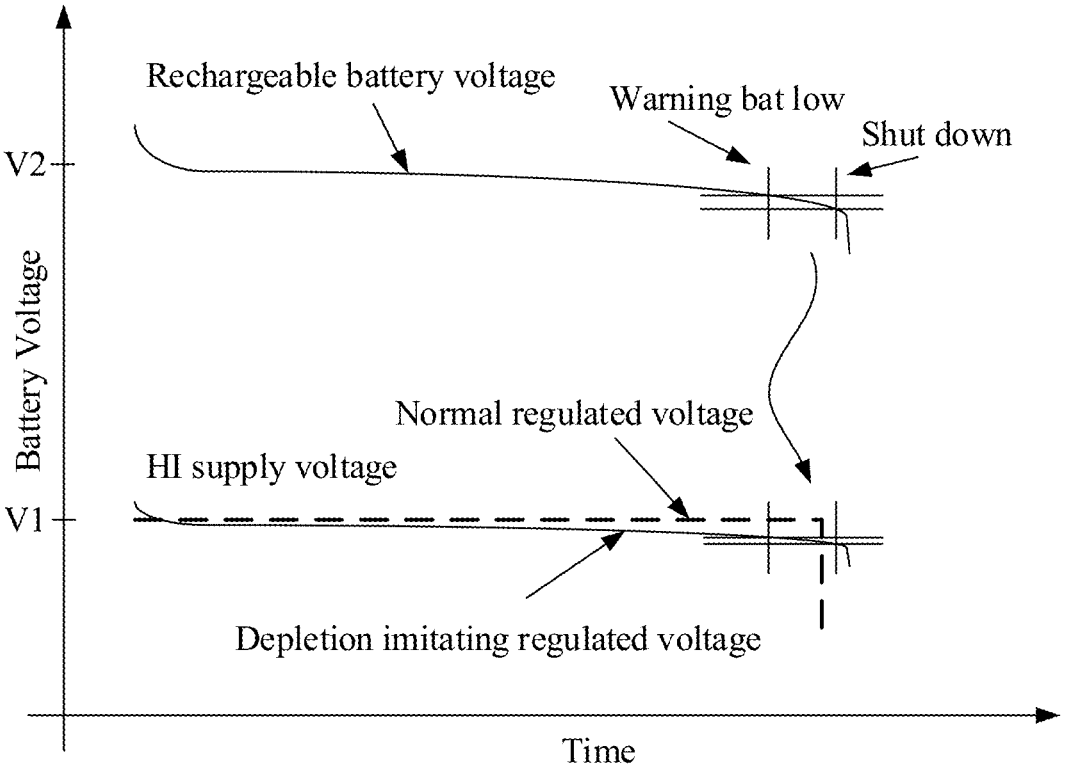

FIG. 7B schematically illustrates (in the top graph) a discharging curve (battery voltage vs. time) for the rechargeable battery (BAT-2) of FIG. 7A. The discharging curve includes hypothetical voltage levels, which should trigger the issue of battery warnings to a user of the hearing aid if the battery voltage decreases below theses threshold levels (cf. 'Warning bat low' and 'Shut down' in FIG. 7B). The bottom graph illustrates a regulated voltage (dashed curve denoted 'Normal regulated voltage' in FIG. 7B) generated from the voltage V2 of the rechargeable battery. It has an abrupt (indicated vertical) fall-off when the input voltage (V2) decreases below a threshold voltage. The regulated voltage is intended for use as supply voltage to the electronic components of the hearing aid (cf. 'HI supply voltage' in FIG. 7B). The abrupt fall-off of the regulated voltage is of course highly un-attractive to the user. Also in the bottom part of FIG. 7B is shown a a typical discharging curve for a normal (non-rechargeable) battery (e.g. for the first battery (BAT-1) of the BTE-module (BTE-M) of FIG. 6). The typical voltage levels for issuing battery warnings to a user of the hearing aid are indicated. By allowing the (regulated voltage of the) second battery to take over the supply of power to the hearing aid and by controlling the regulated voltage in dependence of a typical discharge curve (as further discussed in connection with FIG. 8A, 8B below), the normal battery warning system of the hearing aid can be maintained without changes. Thereby a relatively simple 'retro-fit' of the battery module to already existing hearing aid devices can be achieved.

Figures 8A, 8B:
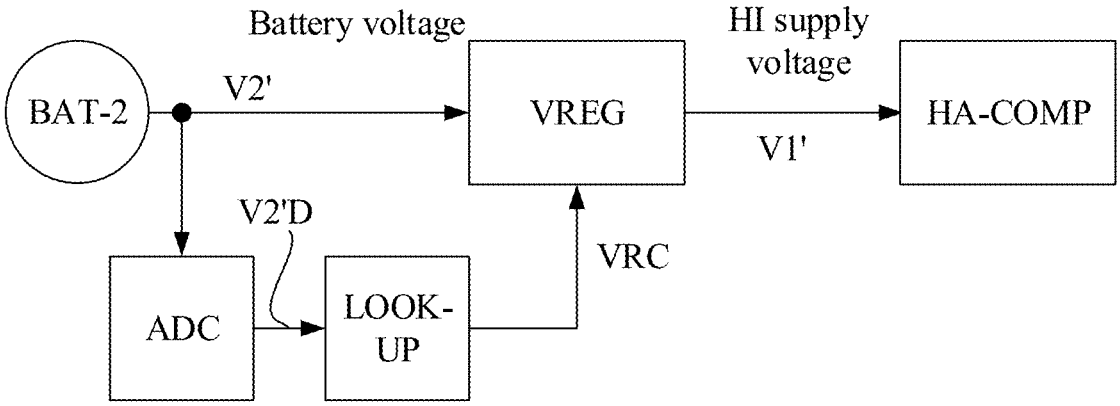
FIG. 8A shows a modular hearing aid or a part thereof comprising a second battery and a voltage regulator for conversion of a second voltage V2' to a hearing instrument supply voltage V1'.
FIG. 8B shows an exemplary look-up table implementing LOOK-UP unit of FIG. 8A for use in controlling the output voltage V1' of voltage regulator VREG in FIG. 8A, so that normal battery warnings can be generated by the hearing aid (represented by block HA-COMP in FIG. 8A), and FIG. 9A schematically illustrates an embodiment of battery module comprising a rechargeable battery for cabled recharging and electric circuitry for converting the voltage of the rechargeable battery to a nominal supply voltage of electronic components of a hearing aid (included in a separate BTE-module)

FIG. 8A shows a modular hearing aid or a part thereof comprising a second battery (BAT-2) and a voltage regulator (VREG) for conversion of a second voltage V2' ('Battery voltage' in FIG. 8A) to a hearing instrument supply voltage V1' (HI supply voltage in FIG. 8A) for supplying power to electronic components of the hearing aid (HA-COMP), as also described in connection with FIG. 7A. In the embodiment of FIG. 8A electric circuitry (cf. e.g. EC of the battery module (BAT-M) in FIG. 6) comprises an analogue to digital converter (ADC) for converting the second voltage of the second (rechargeable) battery (BAT-2) to a digital value V2'D. The digital value V2'D of the second voltage is fed to a memory comprising a look-up table (LOOK-UP) comprising corresponding values of loaded second battery voltages V2'D and intended regulated (first) voltages V1' (as illustrated in FIG. 8B). At a given time t, where the loaded second voltage is V2'D(t) (e.g. 3.4 V in the table of FIG. 8B), the corresponding intended value of the regulated voltage V1'D(t) is read form the table (e.g. 1.2 V) and fed—represented by control signal VRC—to the voltage regulator (VREG) to set the regulated voltage to V1'D(t) (or an analogue equivalent (V1') thereof). The thereby constructed supply voltage is intended to mimic the loaded voltage of the first battery (e.g. a Zn-Air battery) of the BTE-module of the hearing aid.

FIG. 8B shows an exemplary look-up table implementing the LOOK-UP unit of FIG. 8A for use in controlling the output voltage V1' of voltage regulator VREG in FIG. 8A, so that normal battery warnings can be generated by the hearing aid (represented by block HA-COMP in FIG. 8A). The voltages in the bottom part of the table are indicated by Trigger battery warnings. In the example, the battery warnings system is initiated when the (digital) value of the second battery voltage drops to 3.4 V and below. Thereby the drastic fall-off of the regulated voltage illustrated in FIG. 7B can be avoided and a normal warning scheme giving the user a chance to be prepared to the coming shut-down of the hearing aid (e.g. to change to another (preferably fully charged) battery module, or removal of the battery module and insertion of a normal battery in the hearing aid).

In another embodiment, the voltage regulator (VREG) comprises a voltage divider (e.g. providing a fixed fraction F of the current battery voltage V2' as a supply voltage V1'). The voltage divider may e.g. comprise two resistors (R1, R2) coupled over the battery voltage V2' (having values that correspond to the necessary voltage division, i.e. e.g. F=[R1/(R1+R2)]=[V1'/V2']) to the high and low battery voltage, and where the supply voltage V1' is taken as the voltage over one of the resistor (R1) between the low battery voltage and the midpoint between the two resistors.

FIG. 9A schematically illustrates an embodiment of battery module (BAT-M) comprising a rechargeable battery (BAT-2) for cabled recharging and electric circuitry (EC) for converting the voltage of the rechargeable battery to a nominal supply voltage of electronic components of a hearing aid (included in a separate BTE-module, cf. e.g. FIG. 6). The electric circuitry (EC) further comprises circuitry for managing the charging process (e.g. depending on the battery type). The battery module (BAT-M) further contains an electric connector (BAT-M-CON) allowing it to be electrically connected to a (mating) connector in a BTE-module (cf. FIG. 6). The battery module (BAT-M) further comprises a charging connector (CON) for allowing a cabled connection (cf. cable CAB) to a charging station (CHARGER). The connector (CON) may e.g. be a USB connector or equivalent. The charger may also comprise a charging connector (or alternatively be internally connected to the charging cable CAB). The battery module comprises appropriate connecting conductors arranged (e.g. fully or partially on a carrier, such as a PCB) to connect the battery (BAT-2) to the electric circuitry (EC) and to the connectors (BAT-M-CON, CON).

FIG. 9B schematically illustrates an embodiment of battery module (BAT-M) as in FIG. 9A, but being configured for wireless recharging of the rechargeable battery (BAT-2). Instead of (or in addition to) a charging connector, the battery module (BAT-M) of FIG. 9B comprises an antenna (e.g. an inductive coil (COIL)) for allowing wireless transfer of energy to the battery module from a corresponding antenna (COIL) of the charging station (CHARGER) via a wireless link (WL) (indicated by dashed line in FIG. 9B).

FIG. 9C illustrates a charger cradle suitable (CHARGER) for left and right modular hearing aids (HD-L, HD-R) for wireless or wired recharging of a rechargeable battery of a battery module (BAT-M). The battery module (BAT-M) contains the battery, and electronic circuitry comprising a charge management circuit and a voltage converter (e.g. a step-down converter). The left and right hearing aids (HD-L, HD-R) may form part of a binaural hearing aid system, configured to exchange data and audio signals with each other and/or with an auxiliary device (e.g. a remote control or a smartphone containing an APP for providing a user interface for the binaural hearing aid system).

The charger cradle (CHARGER) comprises separate slots for charging each of the left and right hearing aids (HD-L, HD-R) and a cable and connector (M-CON) for connection to a power supply (e.g. the mains).

The left and right modular hearing aids (HD-L, HD-R) each comprise a BTE-module (BAT-M) comprising a first battery for proving a supply voltage to hearing aid components of the BTE-module (and possibly to further electronic components connected to the BTE-module, e.g. to a loudspeaker located in an ear canal of the user). The BTE-module (BAT-M) is detachably attachable to a battery module (BAT-M), cf. 'HI' and 'Add-On Rechargeable Battery' in the insert in the right part of FIG. 9C. The combined BTE- and battery-modules are designed to fit at or behind the external ear (pinna) of a user. The BTE-module may e.g. be electrically connected to an ITE-module (cf. e.g. FIG. 6, where a RITE-style modular hearing aid is illustrated). The BTE-module may e.g. comprise a loudspeaker and be acoustically connected to an ITE-module, e.g. a customized mould, via a tube connecting the BTE-module and the ITE-module.

An advantage of the modular hearing aid comprising a BTE-module and a battery module according to the second aspect is that it provides an existing population of BTE-style hearing aids (comprising a connector, e.g. a DAI or FM or programming connector) with an increased flexibility by providing the option of having a spare power supply in the form of a battery module that is connectable to existing hearing aid connectors. The battery module may be recharged using a charger (e.g. a charger based on power from batteries, e.g. AA or AAA batteries, or based on a mains power supply).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing aid for compensating a user's hearing impairment, the hearing aid comprising at least two separate modules, including, an ITE-module and a BTE-module, where the ITE module is adapted for being located at or in an ear canal of a user, and comprises functional elements for providing a normal function of the hearing aid, including an input unit comprising a microphone for picking up sound from the environment and providing an electric input signal, and/or antenna and transceiver circuitry for wirelessly receiving a direct electric audio signal, a signal processor for processing an electric input signal according to the user's needs and providing a processed signal, a memory accessible to the signal processor; and a loudspeaker for converting an electric signal representing sound to sound, and optionally other functional elements for providing a normal function of the hearing aid;

the BTE-module is adapted for being located at or behind an ear or the user, and comprises a rechargeable battery for providing electric energy to the ITE-module, and where the hearing aid further comprises a connecting part for mechanically and electrically connecting the ITE-module and the BTE-module, wherein the connecting part comprises at least two electric conductors connected to the rechargeable battery and to the ITE-module to allow provision of electric energy to the ITE-module.

2. A hearing aid according to claim 1 wherein the BTE-module is configured to provide that the rechargeable battery has a capacity larger than 100 mAh, when fully charged.

3. A hearing aid according to claim 1 configured to provide more than 48 hours of operation without recharging the rechargeable battery.

4. A hearing aid according to claim 1 configured to provide that the rechargeable battery is a Li-Ion or a Li-Ion polymer battery.

5. A hearing aid according to claim 1 configured to provide that the rechargeable battery is wirelessly rechargeable.

6. A hearing aid according to claim 1 comprising antenna and transceiver circuitry for implementing a wireless interface allowing an exchange of data with another device.

7. A hearing aid according to claim 1 comprising a programming interface for programming the signal processor.

8. A hearing aid according to claim 1 wherein the memory comprises solid state, non-volatile memory, e.g. flash memory.

9. A hearing aid according to claim 1 comprising a user interface.

10. A hearing aid according to claim 1 configured to be remotely controlled via a smartphone and/or a smartwatch or similar body worn electronic device.

11. A hearing aid according to claim 1 configured—in a specific mode of operation—to function as a wireless headset.

12. A hearing aid according to claim 1 wherein the microphone(s), e.g. the ITE-microphone, is configured to pick up the user's own voice, at least in a specific mode of operation.

13. A hearing aid according to claim 1 configured—in a specific mode of operation—to transmit the user's own voice to another device, e.g. a telephone or another hearing aid.

14. A hearing aid according to claim 1 comprising a voice control interface.

15. A hearing aid according to claim 1 comprising a number of bio-sensors for monitoring the state or health of the user.

16. A hearing aid according to claim 1 wherein the BTE-module is configured to be disposable.

17. A hearing aid according to claim 1 consisting of or comprising a hearing instrument, a headset, an earphone, an ear protection device or a combination thereof.

18. A hearing aid for compensating a user's hearing impairment, the hearing aid comprising at least two separate modules, including a BTE module, and a battery module adapted for being connected to the BTE-module, the BTE module and the battery module when connected to said BTE-module being adapted for being located at or behind an external ear (pinna) of a user, the BTE-module comprising one or more hearing aid components, a first battery of a first type exhibiting a first nominal voltage, the first nominal voltage being equal to, or converted to, a nominal supply voltage of said one or more hearing aid components, and a first electric connector configured to electrically connect said BTE-module to said battery part;

the battery module comprising a second battery of a second type exhibiting a second nominal voltage, wherein said second nominal voltage is different from said first nominal voltage, and a second electric connector configured to electrically connect said battery part to said BTE-module;

wherein the hearing aid comprises a voltage converter for converting said second nominal voltage said first nominal voltage, and wherein the hearing aid is configured to bypass the first battery and take over the supply of voltage to said one or more hearing aid components, when the battery module is electrically connected to the BTE-module.

19. A hearing aid according to claim 18 wherein the battery module comprises electronic circuitry, including said voltage converter.

20. A hearing aid according to claim 18 wherein the first battery of the first type is a conventional, non-rechargeable, battery, and wherein the second battery of the second type is a rechargeable battery.

21. A hearing aid according to claim 19 comprising a memory containing voltage data V1'D representing a reference discharging curve of said first battery and corresponding voltage data V2'D of said second battery, the hearing aid being configured to control said voltage converter so that it provides a voltage V1'(t) when the current voltage of the second battery is V2'(t), where t represents a current time.

* * * * *